United States Patent [19]

Okamoto et al.

[11] Patent Number: 4,600,325

[45] Date of Patent: Jul. 15, 1986

[54] PRINTING APPARATUS

[75] Inventors: Tsugio Okamoto; Junichi Maeda, both of Nagoya, Japan

[73] Assignee: Brother Kogyo Kabushiki Kaisha, Nagoya, Japan

[21] Appl. No.: 659,310

[22] Filed: Oct. 10, 1984

[30] Foreign Application Priority Data

Oct. 15, 1983 [JP] Japan ..... 58-193190

[51] Int. Cl.[4] ..... B41J 32/00

[52] U.S. Cl. ..... 400/208; 400/248

[58] Field of Search ..... 400/248, 248.1, 248.2, 400/248.3, 207, 208, 208.1, 194, 195, 196, 196.1, 229, 639.1, 641, 234, 342, 350, 351

[56] References Cited

U.S. PATENT DOCUMENTS

| | | | |
|---|---|---|---|
| 607,405 | 7/1898 | Brigham | 400/351 X |
| 958,818 | 5/1910 | McLaughlin | 400/342 X |
| 4,157,224 | 6/1979 | Purzycki et al. | 400/234 X |
| 4,297,043 | 10/1981 | Dargatz | 400/248 X |
| 4,437,778 | 3/1984 | Miyashita et al. | 400/208 |

FOREIGN PATENT DOCUMENTS

| | | | |
|---|---|---|---|
| 0019649 | 12/1980 | European Pat. Off. | 400/208.1 |

*Primary Examiner*—Charles A. Pearson

*Attorney, Agent, or Firm*—Leydig, Voit & Mayer, Ltd.

[57] ABSTRACT

The present invention relates to a printing apparatus, and more particularly to an arranging structure in which an ink ribbon extended from a ribbon cassette is arranged between a platen and a print head. The printing apparatus comprises a platen rotatably supported on a frame, a print head capable of moving reciprocally along the platen, a ribbon cassette replaceably loaded at one end side of the movable range of the print head and housing an ink ribbon with some portion extending outwardly as a loop, and a ribbon guide body located inside the loop of the ink ribbon and for pulling out the same. The ribbon guide body is movably provided along the platen and enters inside the loop of the ink ribbon when the ribbon cassette is mounted on the frame with the ribbon guide body located at one end side of the movable range of the print head. Further, when the ribbon guide body is moved to the other end side of the movable range of the print head as it is placed inside the loop, the loop of the ink ribbon is pulled out in a long strip with the loop guided on the ribbon guide body. Subsequently, the ribbon guide body is locked at its predetermined position.

1 Claim, 4 Drawing Figures

PRINTING APPARATUS

BACKGROUND OF THE INVENTION

1. Field of the Invention

The present invention relates to a printing apparatus, and more particularly to an arranging structure in which an ink ribbon extending from an ribbon cassette is arranged between a platen and a print head.

2. Description of the Prior Art

As conventional printing apparatus, there has been devised and demonstrated one in which a print head is disposed movably along the platen on a frame. A ribbon cassette is mounted on the frame in such a way that the ribbon cassette is located on one end of a movable range of the print head. Some portion of the ink ribbon extending in a loop outwardly from the ribbon cassette is guided on a guide roller or the like provided on the frame on the other end of the movable range. The loop portion of the ink ribbon is extended between the print head and the platen over the overall movable range of the print head.

However, according to such conventional apparatus, the loop portion of the ink ribbon must be guided on the guide roller or the like on the frame by substantially extending the same to the other end of the movable range of the print head. Therefore, this operation is quite troublesome and, at the same time, causes the operator's hands to get dirty. In addition, unless the extending or guiding operations of the ink ribbon are performed well, the loop portion of the ribbon gets twisted, possibly causing an obstacle to the subsequent ribbon-feeding operation.

SUMMARY OF THE INVENTION

Accordingly, an object of the present invention is to provide a printing apparatus which resolves such defects as described above, and which, despite its simple structure, makes it possible to easily and positively effect the extension of an ink ribbon at the time of loading a ribbon cassette without staining the operator's hands or twisting the ink ribbon.

To attain the aforementioned object, the printing apparatus according to the present invention comprises: a rotatable platen, a print head adapted to be capable of moving reciprocally along the platen in the longitudinal direction thereof within a fixed range; a ribbon cassette which is replaceably mounted at one end of the movement range and houses an ink ribbon, and in which some portion of the ink ribbon extends outwardly as a loop; and a ribbon guide body which is movably installed along the platen in the longitudinal direction thereof, which is located at a position inside the loop of the ink ribbon of the ribbon cassette with the ribbon cassette mounted, and which is disengageably locked at a predetermined position in a condition in which the ribbon guide body is moved from said inside position of said loop of said ink ribbon to the other end side of the movable range of the print head.

Other and further objects of this invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF THE PREFERRED EMBODIMENT

Figure 3:
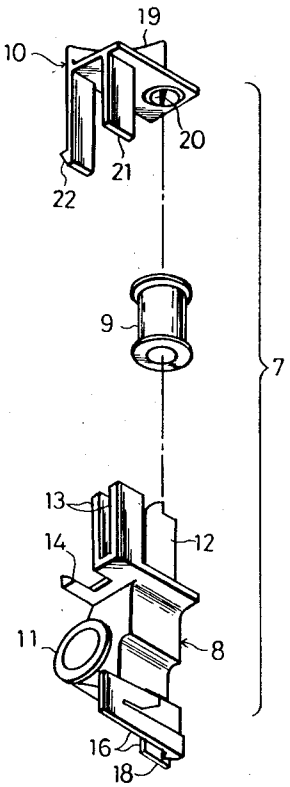
FIG. 3 is a perspective view of a partly exploded ribbon guide body.
Figure 1:
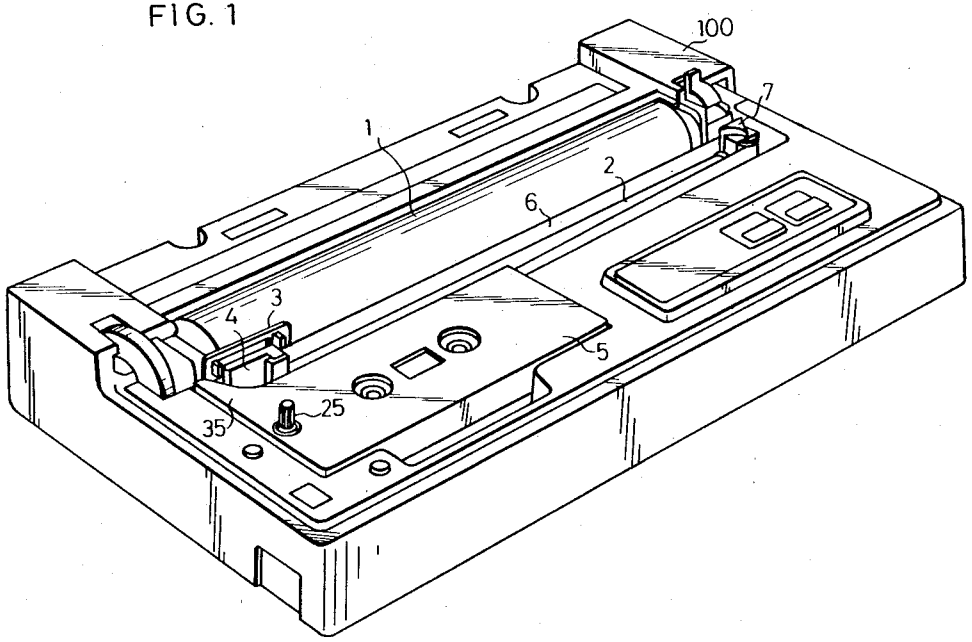
FIG. 1 is a perspective view of a printing apparatus embodying the present invention.

An embodiment of the invention will be described hereinunder with reference to the drawings. A platen is rotatably supported by the frame 100 of the printing apparatus, and a guide rod 2 is mounted on the same in such a way that it extends in parallel with the platen 1. A carriage 3 is movably supported by the guide rod 2, and a thermal print head 4 is supported on the carriage 3 in such a way that the print head 4 is capable of moving along the print line on the platen 1. A ribbon cassette 5 is detachably mounted on a frame 100 at the left end of the movable range of the print head 4. Inside the ribbon cassette 5 is housed a thermal ink ribbon 6 having a thermally transferable ink layer, some portion of which extends in a loop along the side of the platen 1. A ribbon guide portion 35 projecting to the platen 1 is provided at the left end of the ribbon cassette 5. The loop portion of the ink ribbon is formed by this guide portion 35. Also, as is apparent from the figure, the longitudinal width of the ribbon cassette 5 is smaller than the movable range of the print head 4.

A ribbon guide body 7 for extending and guiding the loop portion of the ink ribbon 6 is movably supported by the guide rod 2. As is apparent from FIG. 3, the ribbon guide body 7 comprises a supporting member 8 for supporting the overall ribbon guide body 7, the guide roller 9 for guiding the ink ribbon 6 on the peripheral surface, and an operating member 10 for moving the overall ribbon guide body 7 along the guide rod 2.

A cylindrical member 11 for receiving the guide rod 2 for relative movement is formed in the central portion of the supporting member 8. In its upper portion is formed a supporting shaft 12 for pivotally supporting the guide roller 9, a fork-shaped engaging portion 13 with its upper end open, and an engaging piece 14 located on its side. In its lower portion are formed a pair of elastically clamping pieces 16 that move while clamping from both sides a projecting strip of a guide rail 15 installed on the frame 100 in parallel with the guide rod 2 and below the guide rod 2. A latch 18 for engaging a latching projection 17 provided on the guide rail 15 at the right end side of the movable range of the print head 4 and for locking the ribbon guide body 7 at a predetermined position is formed at the inner side surface of one elastically clamping piece 16. (Refer to FIG. 4)

Furthermore, a knob 19 is formed on the upper portion of the operating member 10. On its lower portion are formed the following: a recess 20 for engaging the upper end of the supporting shaft 12 when this operating member 10 is mounted on the supporting member 8 with the guide roller 9 inserted into the supporting shaft 12 of the supporting member 8; an engaging piece 21 which is similarly engaged from above with the fork-shaped engaging portion 13 of the supporting member 8; and an engaging claw 22 for engaging the engaging piece 14 on the supporting member 8.

Incidentally, the reference numeral 25 denotes a knob for winding the ink ribbon 6.

Figure 4:
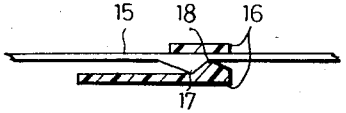
FIG. 4 is a partial cross-section illustrating the ribbon guide body in its locked state.

Accordingly, in a printing apparatus having such an arrangement, if the ribbon cassette 5 is loaded on the frame 100 at the left end of the range of movement of the print head 4 with the ribbon guide body 7 moved to the left end of the movable range, the ribbon guide body 7 is disposed in the loop of the ink ribbon 6, and the loop portion of the ink ribbon 6 is inserted between the print head 4 and the platen 1. In this condition, if the ribbon guide body 7 is moved to the right end of the movement range along the guide rod 2 by means of the knob 19, then some portion of the ink ribbon 6 is engaged around the guide roller 9 of the ribbon guide body 7 and is pulled out from the ribbon cassette 5. Then, as shown in FIG. 4, the latch 18 on the ribbon guide body 7 engages the latching projection 17 on the guide rail 15, thereby locking the ribbon guide body 7 at a predetermined position at the right end of the movable range. As a result, the loop portion of the ink ribbon 6 is extended without causing creases, slackening or the like between the print head 4 and the platen 1 over the entire movement range of the print head 4.

Figure 2:
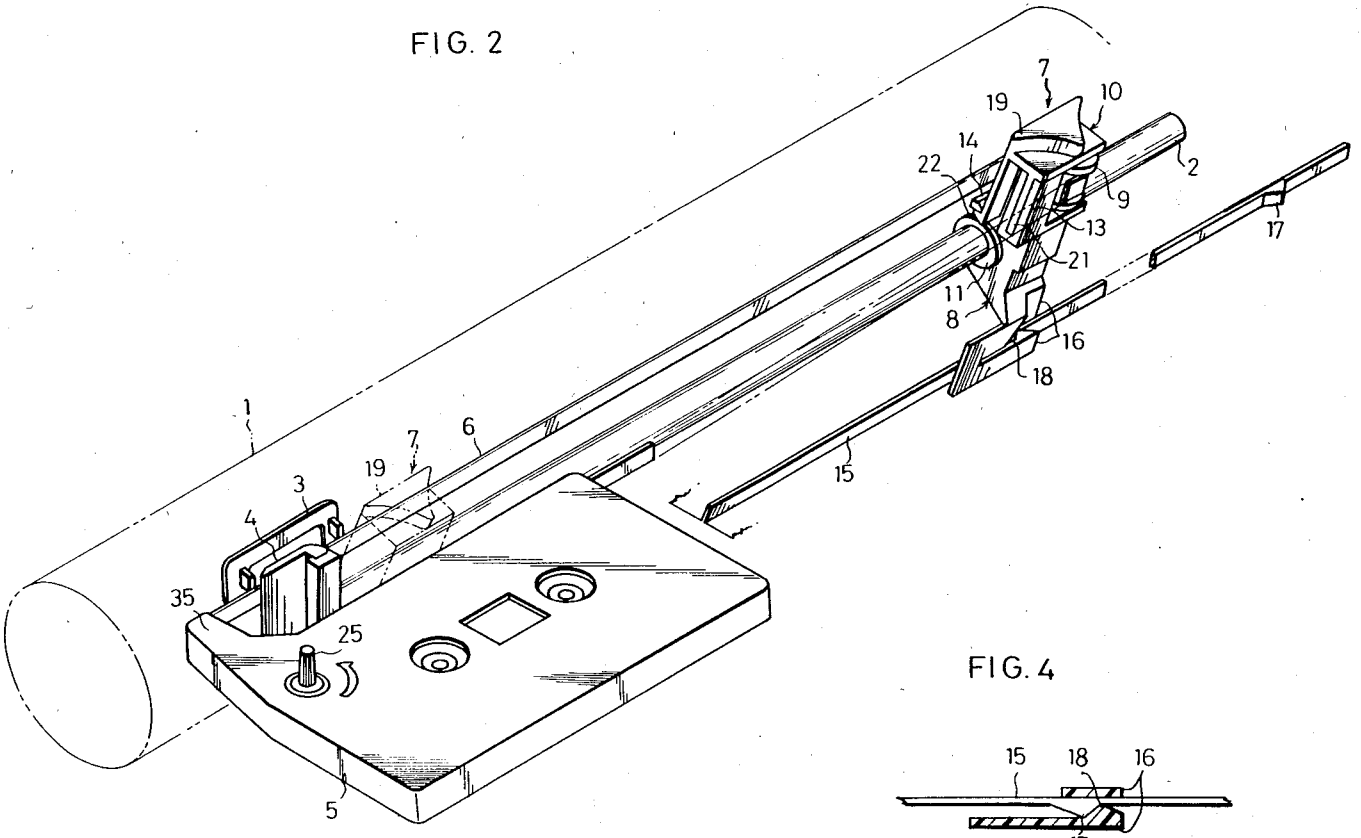
FIG. 2 is a partial expanded perspective view of the printing apparatus shown in FIG. 1.

In addition, when removing the ribbon cassette 5 from the printing apparatus, the engagement between the latching projection 17 and the latch 18 is released if the ribbon guide body 7 is pushed leftwardly with a more than a fixed force. Then, it is possible to dispose the ribbon guide body 7 at the position designated by the two dot and chain line in FIG. 2. Accordingly, it is possible to manually remove the ribbon cassette 5 from the printing apparatus after winding the ink ribbon 6 by means of the knob 25.

Incidentally, in this embodiment, when the ribbon guide body 7 is not locked at the predetermined position at the right end side, if an arrangement is made in such a way that the printing operation is prevented from starting by detecting the unlocked condition by means of a limit switch or the like, or by preventing the top cover from being closed, then it is possible to positively prevent an operational error in which the printing operation is started by mistake when the ink ribbon 6 is not yet extended.

As many apparently widely different embodiments of this invention may be made without departing from the spirit and scope thereof, it is to be understood that the invention is not limited to the specific embodiment thereof except as defined in the appended claims.

What is claimed is:

1. A printing apparatus comprising:

(a) a frame;

(b) an elongated platen rotatably supported by said frame;

(c) a carriage mounted for movement reciprocally along said platen within a fixed range;

(d) a print head supported on said carriage;

(e) a ribbon cassette housing an ink ribbon and replaceably mounted at one end of said frame, a portion of said ink ribbon extending outwardly from said cassette as a loop;

(f) a ribbon guide body mounted for movement along said platen in the same direction as said carriage, said ribbon guide body located at a position inside said loop of said ink ribbon, and disengageably locked at a predetermined position when said ribbon guide body is moved to the end of said frame opposite the end on which said ribbon cassette is mounted;

(g) a guide rod extending along said platen for movably supporting said carriage and said ribbon guide body thereon;

(h) a guide rail adjacent to and parallel with said guide rod for slidably guiding said ribbon guide body, said guide rail having a locking portion for locking said ribbon guide body at one end of said guide rod so that said ribbon guide body does not rotate on said guide rod and the ink ribbon is maintained parallel with the platen;

(i) a suporting member included in said ribbon guide body and slidably provided on said guide rod so as to support the overall ribbon guide body and to be locked by being engaged with said locking portion on said guide rail, said supporting member having an engaging means constituted by a fork-shaped engaging portion with an open upper end, an engaging piece located on the side of said fork-shaped engaging portion, and a supporting shaft;

(j) a guide roller supported on said supporting shaft of said supporting member to lead said ink ribbon over the peripheral surface of said guide roller; and (k) an operating member secured onto said supporting member and including a knob for moving said ribbon guide body, said operating member having an engaging means for engaging said engaging means on said supporting member and for securing said operating member on said supporting member, said engaging means of said operating member being constituted by an engaging piece for being engaged by said fork-shaped engaging portion, an engaging claw for engaging said engaging piece, and a recess for receiving the upper end of said supporting shaft.

* * * * *